US005188075A

United States Patent [19]

Straubel et al.

[11] Patent Number: 5,188,075

[45] Date of Patent: Feb. 23, 1993

[54] FUEL INJECTION PUMP FOR INTERNAL COMBUSTION ENGINES

[75] Inventors: Max Straubel, Stuttgart; Karl Kellermann, Ditzingen, both of Fed. Rep. of Germany

[73] Assignee: Robert Bosch GmbH, Stuttgart, Fed. Rep. of Germany

[21] Appl. No.: 902,347

[22] Filed: Jun. 22, 1992

[30] Foreign Application Priority Data

Aug. 13, 1991 [DE] Fed. Rep. of Germany ..... 4126697

[51] Int. Cl.[5] ..... F02D 31/00

[52] U.S. Cl. ..... 123/357; 123/385

[58] Field of Search ..... 123/357, 388, 359, 502, 123/449, 503, 385, 386, 387

[56] References Cited

U.S. PATENT DOCUMENTS

| | | | |
|---|---|---|---|
| 3,724,430 | 4/1973 | Adler | 123/357 |
| 3,796,197 | 3/1974 | Locher | 123/357 |
| 3,815,564 | 6/1974 | Soda | 123/502 |
| 3,978,837 | 9/1976 | Lundberg | 123/357 |
| 4,019,478 | 4/1977 | Hobo | 123/502 |
| 4,275,691 | 6/1981 | Wolff | 123/385 |
| 4,475,519 | 10/1984 | Eheim | 123/502 |
| 4,538,581 | 9/1985 | Hakansson | 123/502 |
| 4,541,393 | 9/1985 | Sato | 123/502 |
| 4,957,080 | 9/1990 | Howland | 123/386 |
| 4,972,819 | 11/1990 | Engfer | 123/385 |

FOREIGN PATENT DOCUMENTS

| | | | |
|---|---|---|---|
| 0157022 | 9/1982 | Japan | 123/502 |
| 61-35727 | 11/1984 | Japan . | |
| 59-186436 | 8/1987 | Japan . | |
| 2185598 | 7/1987 | United Kingdom | 123/357 |

*Primary Examiner*—Carl S. Miller

*Attorney, Agent, or Firm*—Edwin E. Greigg; Ronald E. Greigg

[57] ABSTRACT

The invention is based on a fuel injection pump in which an adjuster, which may also be an injection onset adjuster, is actuated via an adjusting mechanism, and the adjusting mechanism has an adjusting piston, which is displaceable in a cylinder and is adjustable counter to a restoring force by a pressure fluid. The delivery of pressure fluid to the adjusting piston is controlled via electric valves, making a graduated, geometrically defined adjustment of the adjusting piston possible, but no feedback sensors for the actual status of the adjusting mechanism at a given time are required.

23 Claims, 5 Drawing Sheets

FUEL INJECTION PUMP FOR INTERNAL COMBUSTION ENGINES

BACKGROUND OF THE INVENTION

The invention is based on a fuel injection pump for internal combustion engines. In a known injection pump of this type (Japanese GDS 18 64 36/84), two magnet valves continuously regulate the position of the adjusting piston in the cylinder; the inflow and outflow in the control circuit are each controlled via a separate electric magnet valve, disposed in an incoming and an outgoing fuel line. An injection adjuster is thus positioned in various defined positions continuously, via the adjusting piston. For exact setting of the adjustment, feedback of whatever position has been reached as a result of the adjustment is needed. To obtain this feedback, feedback sensors are necessary. Japanese Design Patent 61 35 727 also discloses a fuel injection pump in which the onset of injection and the injection quantity are determined by means of a reciprocating and rotating slide that is displaceable on the pump piston. With these injection adjusters, it is possible to dispense with the usual injection adjustors, which intervene with force.

In the known injection pump, the reciprocating-/rotating slide is actuated by a shaft that is moved via a rod linkage and an electromagnet. Making a continuous adjustment of this setting device with the aid of electrically or electrohydraulically triggered lever mechanisms also requires using feedback sensors. They indicate the actual state of the setting device at a given time, thereby making it possible for the first time to compare the actual and set-point values. However, the engineering effort that these feedback sensor involve dictates high costs for this type of triggering, so that it becomes an object to find an adjusting mechanism that makes feedback unnecessary.

OBJECT AND SUMMARY OF THE INVENTION

The fuel injection pump according to the invention, has an advantage over the prior art that because of the mechanically defined positions of the adjusting piston, no feedback sensors are needed to attain an exact setting outcome. Because of the defined mechanical structure of the adjuster, an unequivocal mechanical relationship and thus a precise geometric adjustment are possible. With the aid of a simple control circuit, it is possible to control the adjuster. This kind of three-point adjustment, which is simple to achieve in terms of engineering, can meet various demands in terms of setting capabilities, and when advantageously and economically used in an injection onset adjuster in accordance with an embodiment of the invention, it already affords simple adaptation to the injection instant required for the particular operating state of the engine. The most favorable supply onset setting for engine starting, regardless of the buildup of the pressure fluid pressure, is reliably assured by the fixation of the adjusting piston in its outset location by a spring element. Other advantages and advantageous features of the invention can be found in the ensuing description, drawing and claims.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
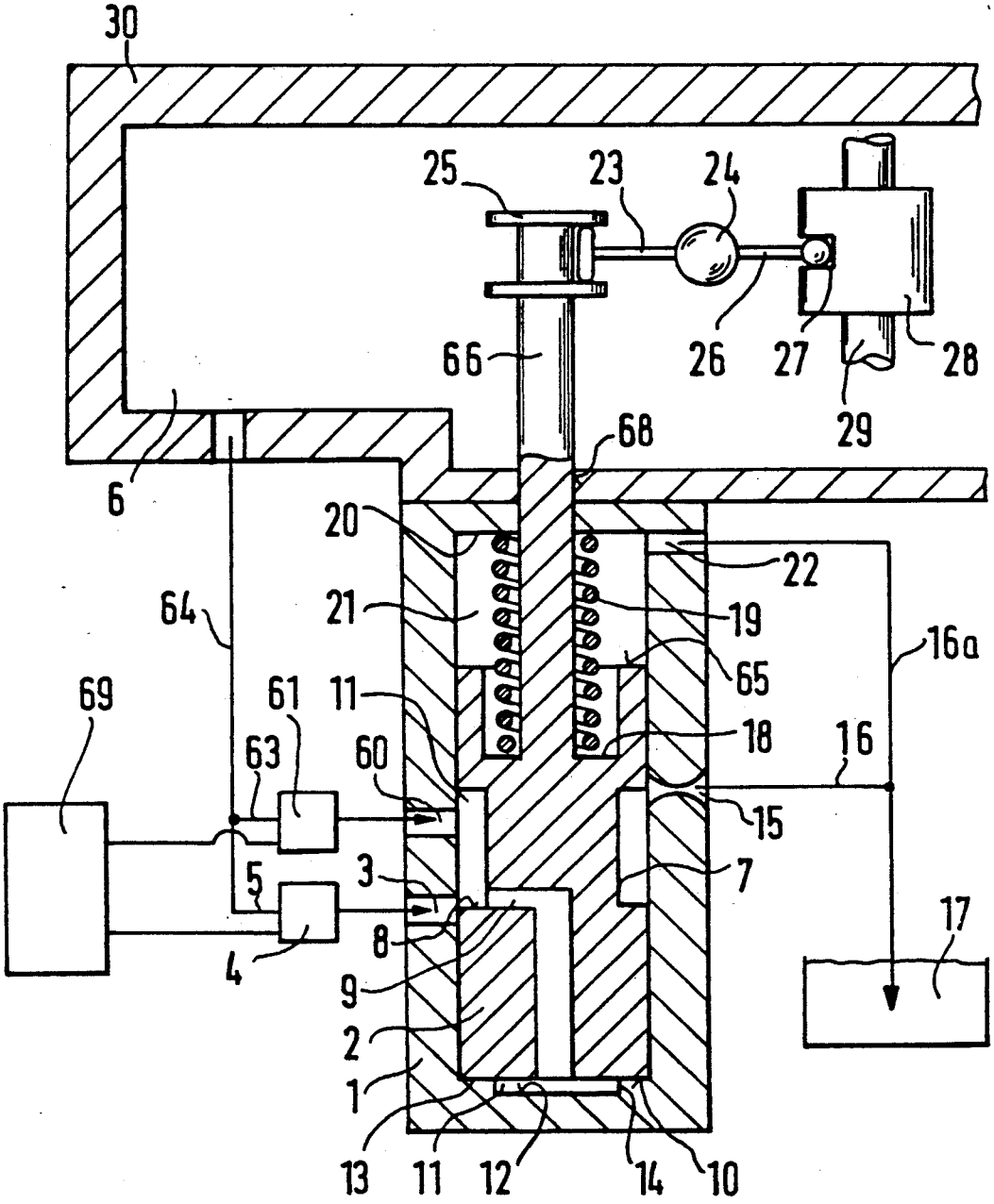
FIG. 1 shows a first exemplary embodiment of the invention, in a longitudinal section through part of the pump suction chamber of the fuel injection pump and through a three-stage adjusting mechanism with a adjusting piston in the outset position and with a schematically shown connection of the adjusting piston with an injection onset adjuster of the fuel injection pump.

FIG. 1 shows a fuel injection pump for internal combustion engines, having an injection adjuster that is actuatable by an adjusting mechanism. This adjusting mechanism comprises an adjusting piston 2, coupled to the injection adjuster; the adjusting piston is displaceable in a cylinder 1 and is adjustable by a pressure fluid counter to a restoring force. A first pressure fluid supply line 5, which includes a first magnet valve 4 that discharges via a first inlet opening 3, and a second pressure fluid supply line 63, which includes a second magnet valve 61 that discharges via a second inlet opening 60, discharge axially in that order into the cylindrical wall of the cylinder 1. The pressure fluid supply lines communicate via a common pressure fluid line 64 with a pressure chamber 6 that is filled with pressure fluid, which is preferably kept at an rpm-dependent pressure by a feed pump driven in synchronism with the fuel injection pump. If this pressure chamber simultaneously acts as a pump suction chamber and is then filled with fuel, fuel is aspirated from it into the pump work chamber of the fuel injection pump. At the level of the inlet openings 3, 60 the adjusting piston 2 has a wide annular groove 7, by which both inlet openings can be made to communicate, and from which a connecting line 9 leads to a first face end 10 of the adjusting piston 2; with this first face end 10 and a first end wall 12 of the cylinder 1, the adjusting piston encloses a work chamber 11. The end wall 12 of the cylinder 1 has a circular indentation 14 and forms a stop 13 for the adjusting piston 2. A throttle bore 15 is used for pressure relief of the work chamber 11; it is made in the cylindrical wall of the cylinder 1 in such a way that over the entire axial motion of the adjusting piston 2, which is defined by the contact of the adjusting piston 2 with the second end wall 20, remote from the end wall 12 of the cylinder 1 toward the work chamber, it discharges into the annular groove 7. From the throttle bore 15, a relief line 16 leads into a relief chamber, that is, the fuel tank 17. The throttle bore 15 and the part of the relief line 16 communicating with it can be omitted if the cylindrical portion of the adjusting piston 2 that is defined by the face end 65 is made somewhat smaller in diameter, so that sufficient fluid for relief can leak away through the play between the adjusting piston 2 and the cylinder 1. A groove or a flat may also be provided in this part of the adjusting piston 2. The second face end 65 of the adjusting piston 2, oriented toward the second end wall 20 of the cylinder 1, has an annular end groove 18, which serves to guide a spring 19 that on its other end rests on the second end wall 20 of the cylinder 1. For pressure relief of the spring chamber 21, receiving the spring 19, between the adjusting piston 2 and the second end wall 20 in the cylinder 1, a return bore 20 leads away from it, communicating with the fuel tank 17 via the relief line 16*a*.

A tapered piston part 66 continues coaxially from the face end 65 of the adjusting piston 2; the tapered piston part protrudes through a bore 68 in the second end wall 20 of the cylinder 1 into the adjoining, fuel-filled pressure chamber 6, where it is for instance coupled to an adjusting lever 23 of a torsion shaft 24 via a fork 25; via an adjusting arm 26, the torsion shaft 24 engages a transverse groove 27 of an annular slide 28, which is axially adjustable, for example, on a pump piston 29, so that by means of the adjusting piston 2 via the tapered piston part 66, the adjusting lever 23 and the adjusting arm 26 can be set. When the engine is started, a fuel pressure builds up in the pressure chamber 6 of the engine-driven fuel injection pump, so that the fuel can be used as the adjusting fluid. This fluid is delivered to the pressure fluid supply lines 5, 63 and 64. When the magnet valves 4 and 61 are closed, the adjusting piston 2 is retained in its outset location o the stop 13 on the first end wall 2 of the cylinder 1 by the spring 19. The annular groove 7 then communicates with the first inlet opening 3 in the second inlet opening 60. If the first, lower magnet valve 4 is then opened by a control device 69, then the pressure fluid flows into the annular groove 7 and on into the work chamber 11 via the connecting line 9. As a result of the hydraulic pressure acting upon the face end 10 of the adjusting piston 2 in the work chamber 11, the restoring force of the spring 19 and the section chamber pressure acting upon the piston part 66 protruding into the pressure chamber 6 are overcome, and the adjusting piston 2 moves axially until the limiting edge of the annular groove 7, located toward the work chamber and acting as a control edge 8, closes the first, lower inlet opening 3. In that position of the adjusting piston 2, an equilibrium develops between the outflow via the throttle bore 15 and a remaining partial inflow cross section located between the control edge 8 and the inlet opening 3. Now, if instead of this thus-attained intermediate position of the adjusting piston 2, a third adjusting piston position is reached, then the second, upper magnet valve 61 is opened, so that fuel continues to flow into the annular groove 7 and the work chamber 11, where the hydraulic pressure is reinforced again, and as a result the adjusting piston 2 is moved farther upward until the inlet opening 60 is closed by the control edge 8 of the adjusting piston 2, and once again as in the above-mentioned position of the adjusting piston 2, an equilibrium is established. The spring chamber 21, which shrinks continuously in the axial reciprocating motion of the adjusting piston 2, is relieved, via the return bore 22; as with the throttle bore 15, the fuel is delivered to the fuel tank 17 via a relief line 16. The positions of the adjusting piston 2, which can accordingly be fixed exactly geometrically in three positions, are transmitted to the torsion shaft 24 via the adjusting lever 23, which is guided in the fork 25 of the adjusting piston 2; via the adjusting arm 26, the torsion shaft 24 converts these positions into an axial motion of the annular slide 28 on the pump piston 29. The position of the adjusting piston 2 in the aforementioned three positions, is defined by the geometric location of the inlet openings 3, 60 and the lower stop 13; these dimensions can be achieved mechanically precisely in manufacture.

Figure 2:
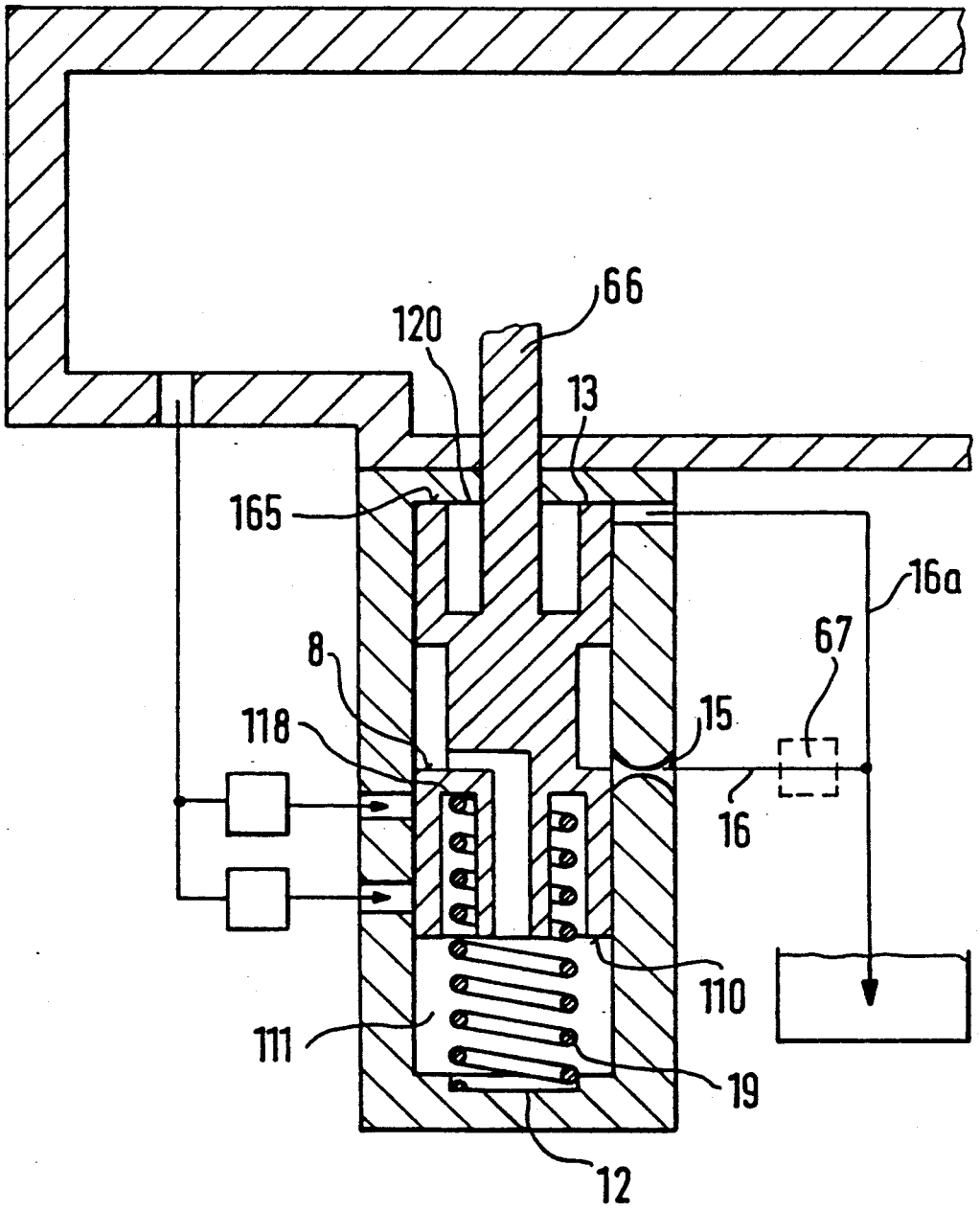
FIG. 2 shows a second exemplary embodiment of the invention in the pressureless outset position, with an adjusting mechanism whose adjusting piston can be put in the outset position by pressure fluid.

The exemplary embodiment shown in FIG. 2 is similar, differing from that shown in FIG. 1 only in that now the compression spring 19 is fastened to the other end of the adjusting piston 2, between the first face end 11 of the adjusting piston 2 and the end wall 12 of the cylinder 1 that defines the work chamber 111 on the spring side, and it keeps the adjusting piston 2, by its upper, second face end 165, in contact with the upper, second end wall 120 of the cylinder 1 in the absence of fuel pressure in the pressure chamber 6, in a first outset position. An annular end groove 118 on the first face end 110 in the adjusting piston 2 serves to guide the spring 19. Also, an additional magnet valve 67 can be provided in the relief line 16, adjacent to the throttle bore. In the position of repose, or in other words when the engine is off and there is no suction chamber pressure, the spring 19 presses the adjusting piston 2 toward the upper end wall 120 of the cylinder; this position is transmitted to the control slide in a manner analogous to that described in FIG. 1 and will therefore not be described further here. Once the engine or the fuel injection pump is started, the pressure in the pressure chamber 6 builds up and acts upon the adjusting piston part 66 protruding into that chamber. The suction chamber pressure on the face end of the adjusting piston part 66 is adequate to press the adjusting piston 2 against the stop 13 of the cylinder 1, counter to the restoring force of the compression spring 19. Beginning at this second position, which characterizes the outset position of the adjusting piston 2 when the engine is in operation, the function of the exemplary embodiment shown in FIG. 2 is equivalent to that of FIG. 1, except that now the restoring force is embodied by the suction chamber pressure, which is counteracted by the force of the spring, which in this case is soft and only slightly prestressed, and the pressure controlled in the work chamber 111 and acting on a larger surface area. If the adjusting piston 2 is also to be firmly restrained in its upper extreme position even after engine starting, then it is possible, by closing the magnet valve 67, to prevent the relief of the work chamber ;11 via the throttle bore 15; the result is a hydraulic blockage of the adjusting piston 2. This arrangement may be used in order to attain an extreme injection onset for engine starting and warmup.

Figure 3:
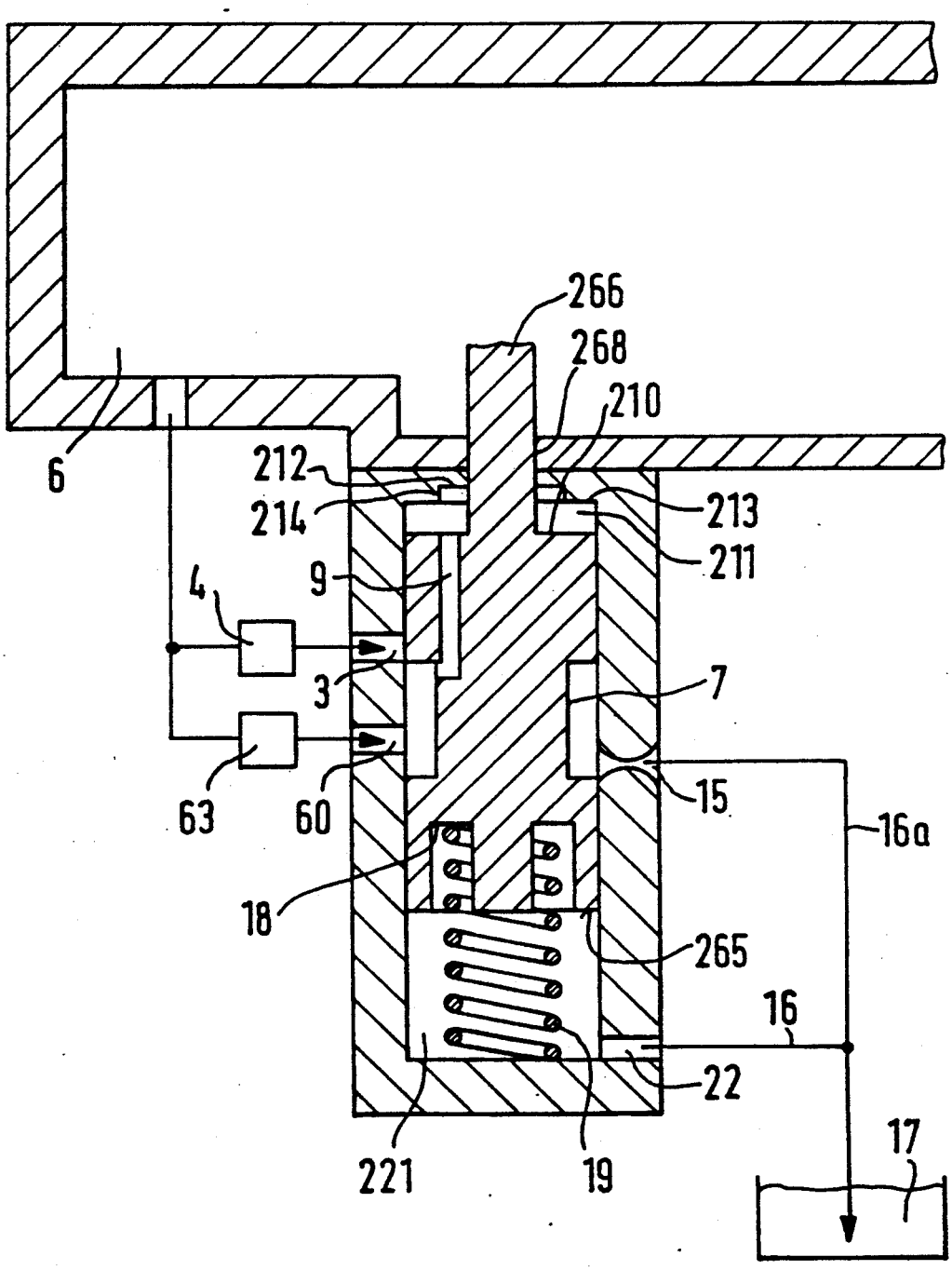
FIG. 3 shows a third exemplary embodiment of the invention, with a reversal of the action upon the adjusting piston by a pressure fluid counter to a restoring spring.

For kinematic reasons, resulting from pump construction, it may be necessary to have an adjusting mechanism with the opposite adjusting direction; this is shown in FIG. 3. This exemplary embodiment has the same structure as that described and shown in FIG. 1, except that here the tapered part 266 of the adjusting piston 2 does not begin at the face end 265 of the adjusting piston 2 defining the spring chamber 221, but rather at the face end 210 adjoining the work chamber 211, and is guided by the first end wall 212, which is now adjacent to the suction chamber 6, via a bore 268 provided there. The outset location is fixed by the compression spring 19 such that the adjusting piston 2, with the now annular face end 210 because of the adjusting piston part 266, is pressed against the stop 213 of the second cylinder end wall 212; once again, an indentation 214 defines the minimum size of the work chamber 211 there. After the engine has been started, this exemplary embodiment functions analogously to that described in FIG. 1, but in the opposite direction of motion.

Figure 4A:
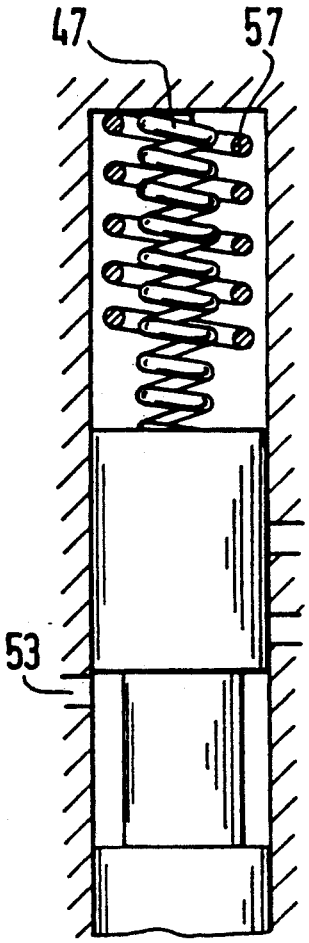
FIGS. 4*a*, 4*b*, and 4*c* show an electromagnetically actuated slide valve arrangement, which replaces two magnet valves and operates counter to two different springs.
Figure 4B:
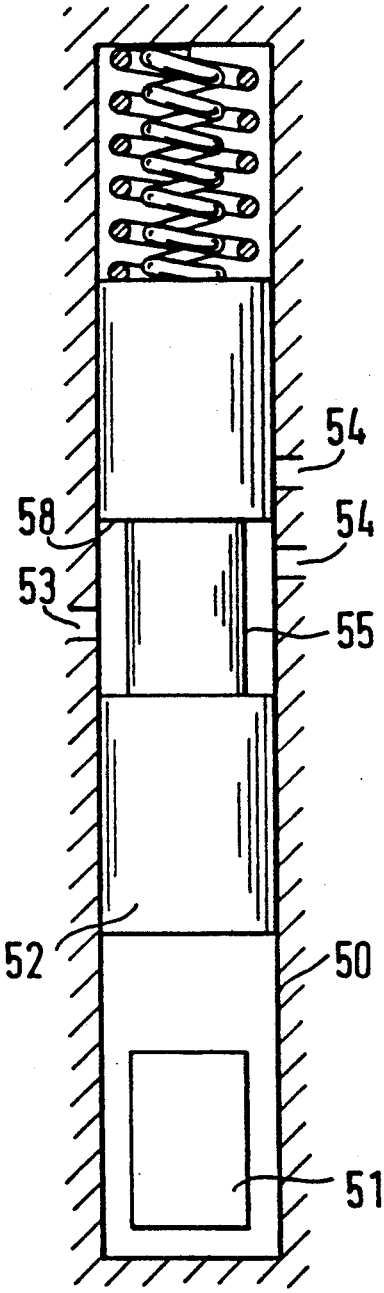
Figure 4C:
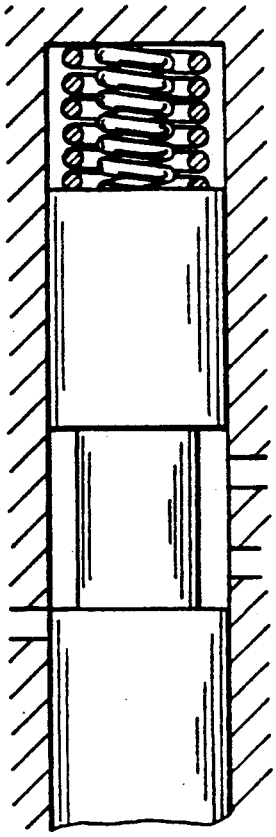
Figure 5:
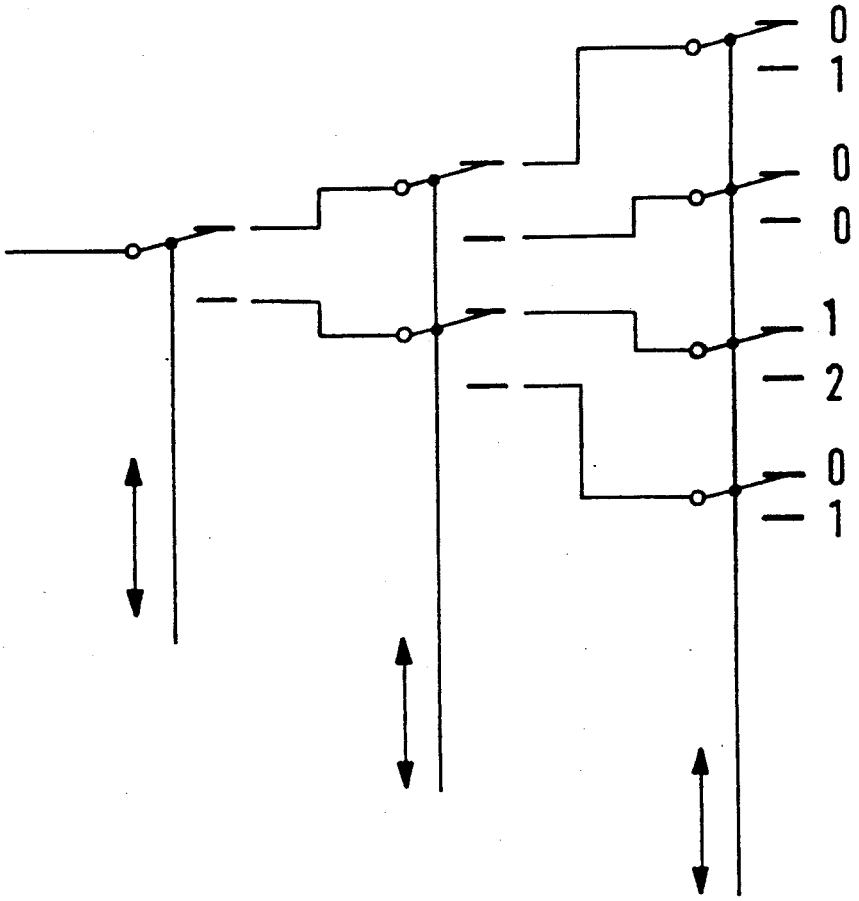
FIG. 5 is an example of a circuit diagram for the circuit of the magnet valves as a function of the temperature, rpm and injection quantity.

In FIGS. 4*a*, 4*b*, and 4*c*, an electrically actuated slide valve is shown, which can be used instead of the magnet valves 4, 61 used in FIGS. 1-3. An electromagnet 51 is located in a housing and acts upon a valve slide, which is tightly displaceable in a cylinder 50 and is in the form of a piston 52, which in the region of an inlet opening 53 and two outlet openings 54 from the cylinder 50 have an annular groove 55, one lateral limiting edge of which acts as a control edge 58. The adjusting motion of the electromagnet 51, via the valve slide 52, acts counter to springs 47 and 57 located on the other face end of the cylinder 50; the springs, which are axially defined by the valve slide 52 and the end wall of the cylinder 50, are of different lengths, so that they come into action only one after the other upon any displacement of the valve slide 52. The valve slide 52 is put into its outer extreme position (position a in FIG. 4) by the first, longer spring 47, and the control edge 58 keeps inlet opening 53 and the outlet openings 54 closed. If the electromagnet 51, at a first excitation intensity, then displaces the valve slide counter to the second, longer spring 47, then the inlet opening 53 and the lower outlet opening 54 are opened b the control edge 58 and made to communicate with one another via the annular groove 55 (position b, FIG. 4). This axial motion of the valve slide 52 ends upon contact of the face end of the valve slide 52 with the shorter spring 57, because the force generated by the electromagnet 51 is not sufficient, in this functional stage, to overcome the spring force of both springs. If the excitation of the electromagnet 51 is then increased, then it also overcomes the additional force of the second spring 57, so that the valve slide 52 also uncovers the second outlet opening 5, and the fuel can now flow out of both outlet openings (position c, FIG. 4). The outlet openings then communicate with the inlet openings at the adjusting mechanisms as in FIGS. 1-3. For problem-free function, it is necessary for the inlet opening 53 to be uncovered first, via the control edge 58 on the valve slide 52, so that a pressure can build up in the annular groove 55. Since it is necessary to regulate the injection onset as a function of load, rpm and temperature, a single circuit can trigger the magnet valves 4, 63 or the slide valve of the control mechanism. To that end, the various signals can be connected to simply yes/no circuit elements via logic linkages as in FIG. 5 and can be passed onto the magnet valves 4 in the form of two signals (ON/OFF). If a microprocessor is used, the three positions of the supply onset adjusting mechanism of the fuel injection pump according to the invention can be triggered in accordance with complicated principles as well.

As a guide variable, defined temperature states are assumed: a cold engine or cold starting, and an engine at operational temperature. Accordingly, defined rpm values, for instance two values, are secondary the temperature states, and then various load states are in turn secondary to the rpm values. From this logical linkage, selected injection onset adjustments can be set in association with the aforementioned operating states With the adjusting mechanism of the invention, it is also possible to furnish more intermediate positions than given in the exemplary embodiment, with suitably more controlled pressure fluid inlet openings into the cylinder, which are controlled by a correspondingly embodied linking circuit.

The foregoing relates to preferred exemplary embodiments of the invention, it being understood that other variants and embodiments thereof are possible within the spirit and scope of the invention, the latter being defined by the appended claims.

What is claimed and desired to be secured by Letters patent of the United States is:

1. A fuel injection pump for internal combustion engines, having a cylinder (1), an adjuster that is actuatable by an adjusting mechanism in said cylinder, said adjusting mechanism has an adjusting piston (2) coupled to the adjuster and displaceable in the cylinder (1), said piston defines a work chamber (11) with one end of said cylinder and is adjustable counter to a restoring force by a pressure fluid, said pressure fluid is delivered to the work chamber via a pressure fluid supply line (5) having an electrically controlled valve (4), the valve (4) is controlled by an electric control device and the adjusting piston (2) is forced by the restoring force to an outset position defined by a stop, the pressure fluid supply line (5) discharges via an inlet opening (3) in a cylindrical wall of the cylinder (1), and in the outset position of the adjusting piston (2), the inlet opening (3) communicates with a second inlet opening of a connecting line (9), which is in the adjusting piston and leads into the work chamber (11), said work chamber is defined by a first face end (10) of the adjusting piston (2) and a first end wall (12) of the cylinder (1), the first and second inlets are provided with limiting edges which form control edges, and after these edges overtake one another, communication between the work chamber (11) and the inlet opening (3) of the pressure fluid supply line (5 is interrupted and the work chamber (11) communicates continuously with a relief chamber (17) via a throttle (15).

2. A fuel injection pump as defined by claim 1, in which at least two pressure fluid supply lines (5, 63), which are regulated in their flow by electrically triggered valves (4, 61) in the various pressure fluid supply lines (5, 63), discharge in axial succession into the cylindrical cylinder wall, and the second inlet opening of the connecting line (9), after closure of the inlet opening (3) toward the work chamber of the pressure fluid supply lines (5), communicates with the next inlet opening (60) remote from the work chamber in successive order of the pressure fluid supply lines (63).

3. A fuel injection pump as defined by claim 2, in which the electrically triggered valves (4, 61) in each pressure fluid supply line (5, 63) are magnet valves (4, 61).

4. A fuel injection pump as defined by claim I, in which the inlet opening (3) is electrically controlled via a common slide valve (52).

5. A fuel injection pump as defined by claim 2, in which the inlet opening (3) is electrically controlled via a common slide valve (52).

6. A fuel injection pump as defined by claim 3, in which the inlet opening (3) is electrically controlled via a common slide valve (52).

7. A fuel injection pump as defined by claim 4, in which the slide valve (52) comprises a piston, which is displaceable in a cylinder (50) by an adjusting magnet (51) counter to a force of a plurality of series-connected springs (47, 51) that come into action successively after various displacement paths of said piston, wherein the piston has an annular groove (55) that communicates continuously with a pressure fluid line opening (53), and in the outset position of the piston the pressure fluid supply lines (5, 63), and after each displacement of the piston until it contacts the next spring (47, 57) in succession, one of the pressure fluid supply lines (5, 63) at a time communicates with the annular groove (55).

8. A fuel injection pump as defined by claim 1, in which an annular groove (7) is provided on the circumference of the adjusting piston (2), from which groove the second connecting line (9) leads to the work chamber (11), and whose limiting edge toward the work chamber forms a control edge (8) that controls the inlet opening of the pressure fluid lines.

9. A fuel injection pump as defined by claim 2, in which an annular groove (7) is provided on the circumference of the adjusting piston (2), from which groove the second connecting line (9) leads to the work chamber (11), and whose limiting edge toward the work chamber forms a control edge (8) that controls the inlet opening of the pressure fluid lines.

10. A fuel injection pump as defined by claim 3, in which an annular groove (7) is provided on the circumference of the adjusting piston (2), from which groove the second connecting line (9) leads to the work chamber (11), and whose limiting edge toward the work chamber forms a control edge (8) that controls the inlet opening of the pressure fluid lines.

11. A fuel injection pump as defined by claim 4, in which an annular groove (7) is provided on the circumference of the adjusting piston (2), from which groove the second connecting line (9) leads to the work chamber (11), and whose limiting edge toward the work chamber forms a control edge (8) that controls the inlet opening of the pressure fluid lines.

12. A fuel injection pump as defined by claim 1, in which the restoring force upon the adjusting piston (2) is effected by a compression spring (19).

13. A fuel injection pump as defined by claim 12, in which the compression spring (19) is guided in an annular end groove (18) in a second face end (65) of the adjusting piston (2).

14. A fuel injection pump as defined by claim 1, in which the adjusting piston (2), on one of its face ends (65, 210), has a tapered part (66) that as an actuating bolt of the adjuster protrudes through a bore (68, 268) in an end wall (20) of the cylinder (1) into a pressure chamber (6) of the fuel injection pump, which chamber is filled with pressure fluid.

15. A fuel injection pump as defined by claim 14, in which the chamber enclosed between the end wall (20) and the face end (65) of the adjusting piston (2) having the tapered part (66) is pressure-relieved via a relief line (16*a*).

16. A fuel injection pump as defined by claim 14, in which the chamber enclosed between the end wall (20) and the face end (65) of the adjusting piston (2) having the tapered part (66) forms with the work chamber (II, 211).

17. A fuel injection pump as defined by claim 14, in which a pump suction chamber pressure of the fuel injection pump, supplied with pressure fluid at preferably rpm-dependent pressure by a feed pump driven in synchronism with the fuel injection pump serves as a pressure fluid source for the pressure fluid supply line (5).

18. A fuel injection pump as defined by claim 8, in which the adjusting piston (2), on its second face end (65), has a tapered part (66) which as an actuating bolt of the adjuster extends through a bore (68) in the second end wall (20) of the cylinder (1) into a pressure chamber (6) of the fuel injection pump, and the pressure of the pressure fluid acting upon the cross-sectional face of the tapered part serves as a restoring force, wherein the pressure chamber (6) is the pressure fluid source for the pressure fluid supply line (64).

19. A fuel injection pump as defined by claim 18, in which the adjusting piston (2), when the pressure chamber (6) is pressureless, is moved against a stop (13) remote from the work chamber by a retaining spring (19), and in this process the pressure fluid supply line (5) is closed by the control edge (8), while upon a pressure rise in the pressure chamber (6) the adjusting piston can be put in its outset position.

20. A fuel injection pump as defined by claim 1, in which the adjuster serves to adjust a member that adjusts the injection onset of the fuel injection pump.

21. A fuel injection pump as defined by claim 1, in which the fuel injection pump has a pump piston (29), which in a cylinder encloses a pump work chamber, which communicates with a pressure chamber (6) via a relief line extending within the pump piston and whose outlet is controllable by means of a control edge on an annular slide (28) that is adjustable on the pump piston, and for injection onset adjustment, the adjuster is coupled to the annular slide.

22. A fuel injection pump as defined by claim I, in which the triggering of the valves is effected as a function of load and/or temperature and/or rpm.

23. A fuel injection pump as defined by claim 22, in which the magnet valves (4, 61) are controlled via a logic linkage circuit that detects various operating parameter states, with the temperature as a guide variable, followed by the rpm and load.

* * * * *